United States Patent [19]

Belanger

[11] Patent Number: 4,998,996

[45] Date of Patent: Mar. 12, 1991

[54] ADJUSTABLE FULCRUM FOR HAMMERS

[76] Inventor: Jacques F. Belanger, 240 Moy Ave., Windsor, Ontario, Canada, N9A 2N2

[21] Appl. No.: 440,503

[22] Filed: Nov. 22, 1989

[51] Int. Cl.[5] ..... B25C 11/00

[52] U.S. Cl. ..... 254/26 E

[58] Field of Search ..... 254/26 E, 26 R, 25, 254/129; 81/169, 170, 175

[56] References Cited

U.S. PATENT DOCUMENTS

| | | | |
|---|---|---|---|
| 1,226,413 | 5/1917 | Thompson | 254/26 E |
| 2,553,102 | 5/1951 | McLean . | |
| 2,589,046 | 3/1952 | Brown et al. . | |
| 2,589,047 | 3/1952 | Brown et al. . | |
| 2,643,854 | 6/1953 | Johnson . | |
| 2,741,456 | 4/1956 | Williams . | |
| 2,748,640 | 6/1956 | Alexander | 81/175 |
| 4,422,620 | 12/1983 | Nitzberg . | |

*Primary Examiner*—Robert C. Watson

*Attorney, Agent, or Firm*—Barnes, Kisselle, Raisch, Choate, Whittemore & Hulbert

[57] ABSTRACT

A hammer comprising an anvil, bell and claw at the head end and a hollow handle into which is housed an adjustable fulcrum mechanism axially disposed and consisting of a fulcrum rod fitted with a cushioned protective tip at the exposed end, said rod matingly matching an aperture in the hammer's bell, and said rod being axially coupled to manual rotating means terminating with a control knob exposed at the grip end of said handle.

8 Claims, 2 Drawing Sheets

ADJUSTABLE FULCRUM FOR HAMMERS

BACKGROUND

1. Field of Invention

The present invention relates to hammers in general and, in particular, to a claw hammer provided with an improved extendable fulcrum to reduce the effort required in removing nails.

2. Prior Art

Heretofore, various modifications have been provided to conventional claw hammers in order to aid the carpenter in removing nails which, among other reasons, are retained within a wood surface and have been driven in improperly or have struck a knot and cannot be driven completely therein. This type of problem occurs frequently and the carpenter is obliged to waste precious amounts of time to remove said nails from the wood. Furthermore, said carpenter must be careful not to mar the surface of the wood from which said nails are being pulled. As is well known, the more difficult the nail removal, the more likely there will be damage to the nail bearing surface on use of the claw hammer.

Many are those who have attempted to remediate to this problem, either by attaching auxiliary fulcrum means to the hammer head or by adding intrinsic extendable fulcruming mechanisms inside the hammer proper.

Belonging to the first group, and worth considering, are the following U.S. Pat. Nos. 2,643,854 and 2,553,102. Belonging to the second group and equally worthy of consideration are the following U.S. Pat. Nos. 2,589,046, 2,589,047, 2,741,456, and 4,422,620. However, hammer head add-ons have proven to be unreliable because they substantially change the shape of the hammer head, thereby causing said head to be disproportionate and in effect becoming a hindrance and interfering with the accomplishment of the work at hand. They also tend to fall off during constant use of the hammer.

Conversely, extendable fulcrums of the prior art have been bulky, complicated in their manufacturing, since most of them make use of notches, latches, springs, etc. . . An exception is U.S. Pat. No. 2,741,456 wherein the extruding part is not a fulcrum, but a pry bar. However, in most of the above mentioned references of the second group, this type of adjustable fulcrum has a considerable number of disadvantages. First, the plunger is difficult to manufacture and cannot be obtained as a standard part. The notches weaken the plunger and provide places where it can easily break as well as interrupt spacing. The plunger must be kept in an orientation where the latch will mesh with one of the notches, thus complicating the internal construction of the handle. The notches will wear and eventually the plunger will not be able to lock firmly in position. Finally, while using this configuration of parts, if the latch is accidentally struck during rebounding off the strike surface, the fulcrum will prematurely eject. On the other hand, in the case of U.S. Pat. No. 4,422,620, which in one embodiment, makes use of a solid cylindrical rod for a fulcrum rod, said fulcrum rod is locked in place by a set screw. Slippage and marring of said fulcrum rod would certainly occur when brute strength is applied to remove a nail that offers even moderate resistance. In the case of U.S. Pat. Nos. 2,589,046 and 2,589,047, the extended fulcrums are kept in their operational position by the pulling action of a tension spring, hardly a dependable and strong embodiment.

OBJECTS AND ADVANTAGES

1. To provide a simple device to improve the ability of claw hammers to remove long nails from a surface.

2. To provide a claw hammer with a fulcrum which minimizes the effort of the user thereof to remove nails.

3. To provide a claw hammer with an improved fulcrum for removing nails which will not fall off or loosen during constant use of the hammer.

4. To provide a claw hammer fulcrum that is simple and inexpensive to manufacture as it contains a minimum of parts, while providing an improved fulcrum point.

5. To provide an improved fulcrum which will not interfere in the achievement of the work to be done, while using the hammer for its primary purpose.

6. To provide a cushioned contact surface preventing the metallic fulcruming means from contacting the nail bearing surface in order to prevent said nail bearing surface from being marred.

7. To provide an improved fulcrum which is and remains a permanent part of the hammer.

8. To provide an improved fulcrum which is strong enough in construction as to exceed any application of human brute force when properly applied.

9. To provide a fulcrum which is capable of extending beyond the limited range of the existing prior art.

10. To provide a fulcrum which doesn't weaken any part of the hammer's head or handle by removing material therefrom to accomodate the insertion of the fulcrum parts.

11. To provide an improved fulcrum which can be re-adjusted while in the process of removing a nail, without requiring to disengage said nail, re-adjust the said fulcrum and then re-engage said nail with the claw.

12. To provide an improved fulcrum which, by virtue of its design, does not require locking the fulcrum bar or rod in either the operating or the retracted position.

LIST of REFERENCE NUMERALS

Nota Bene: All double digit numerals pertain to a fulcrum mechanism part, the first numeral corresponding with the figure number.

Figure 1:
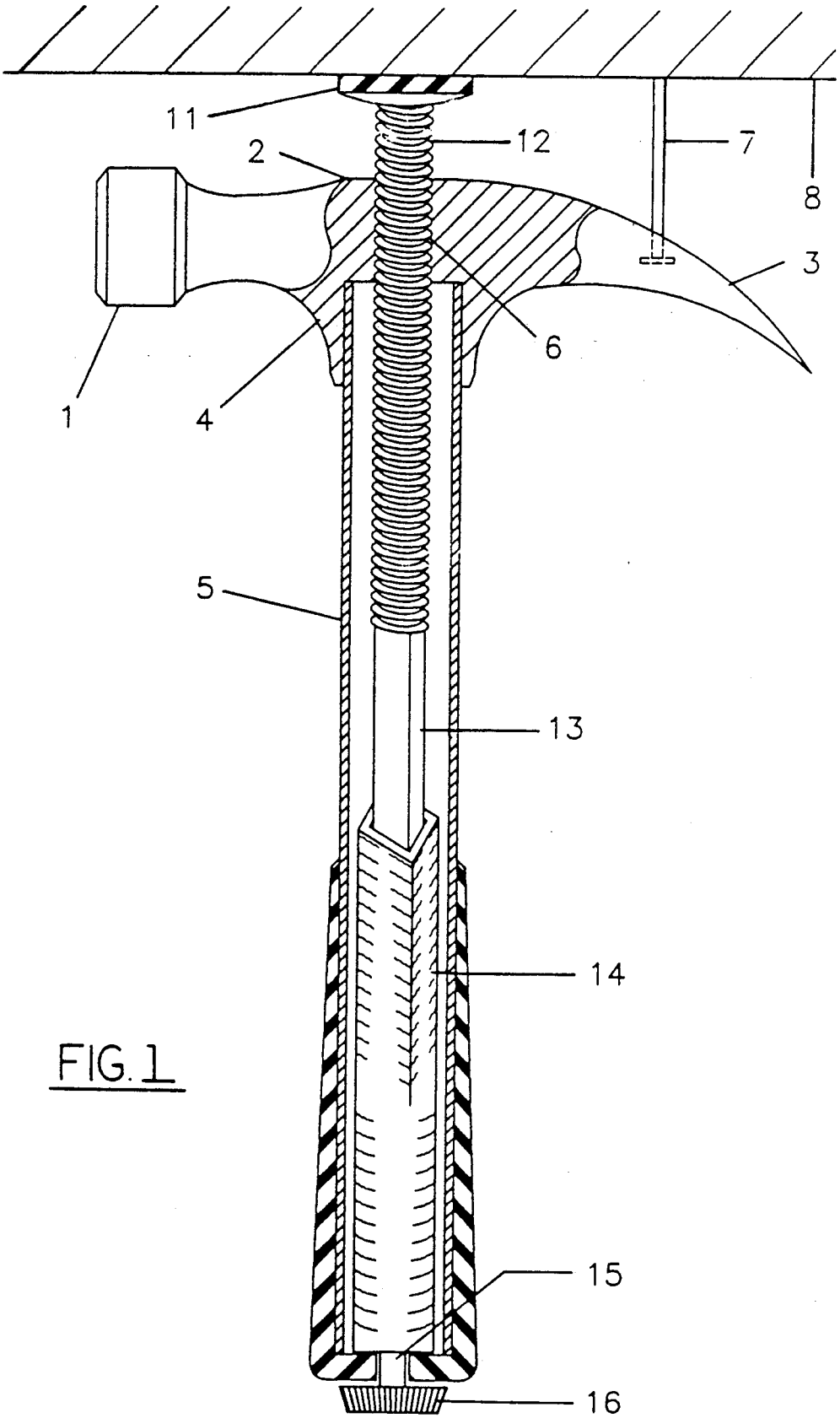
FIG. 1 depicts a claw hammer complete with a fulcrum mechanism. This prefered embodiment consists of axially disposed contact pad, fulcrum rod, rotating means and knob.

| FIG. 1 | |
|---|---|
| 1. Anvil | 11. Elastomeric pad |
| 2. Bell | 12. Threaded fulcrum rod |
| 3. Claw | 13. Machined section |
| 4. Head | 14. Rotating means |
| 5. Handle | 15. Connecting means |
| 6. Aperture (threaded) | 16. Knob |
| 7. Nail | |
| 8. Nail bearing surface | |
| FIG. 2 | FIG. 3 |

-continued

| | |
|---|---|
| 21. Elastomeric pad | 31. Elastomeric pad |
| 22. Threaded fulcrum rod | 32. Threaded fulcrum rod |
| 23. Slot | 33. Slot |
| 24. Rotating means (blade) | 34. Rotating means |
| 25. Connecting means | 35. Connecting means |
| 26. Knob | 36. Knob |
| | 37. Transversal pin |
| FIG. 4 | FIG. 5 |
| 41. Elastomeric pad | 51. Elastomeric pad |
| 42. Threaded fulcrum rod | 52. Smooth fulcrum bar |
| 43. Coil fastening hole | 53. Internal female thread |
| 44. Helical coil (spring) | 54. Male threaded screw |
| 45. Connecting means | 55. Connecting means |
| 46. Knob | 56. Knob |

DESCRIPTION OF INVENTION

The present invention relates to an improved fulcrum of the type generally discussed above. It is adapted to be used with a hammer which is essentially conventional and will have a handle (5) which is shaped to fit within a conventionally built steel or cast metal head (4) having conventional striking end or anvil (1), nail pulling end or claw (3) and fulcrum or bell (2). But in the present case, FIG. 1 shows a fulcrum rod (12) which is preferably a threaded rod, mounted to be fully rotatable within the interior space in the handle (5) of the hammer and extends through a matingly tapped aperture (6) practiced in the bell (2) of the hammer's head (4) to the upper surface thereof. The opposite end of said threaded rod (12) is machined flat (13) on at least two sides, said two sides being preferably opposite one another. In addition, rotating means (14), such as a section of round tubing, axially in line with and of a diameter approximating that of the said threaded rod (12), are flattened at one end to matingly fit and slide over the aforementioned machined end (13) of the said threaded rod (12), the other end of said section of round tubing (14) being made to extrude past the grip end of said hammer's handle (5) to be connected (15) to, and terminated with a control knob (16), the purpose of said knob (16) being to manually rotate the fulcrum mechanism and said knob being one of only two parts which are visible outside the hammer, the other part being a cushion or protective pad (11) of elastomeric material affixed to the end of the said threaded section of the said fulcrum rod (12) which is designed to extend past and retreat flush with the outside surface of said hammer's bell (2).

OPERATION OF INVENTION

The operation of this invention will be clearly understood from a consideration of the foregoing description of the mechanical details thereof, taken in connection with the drawings and the above recitation of the objects of this invention.

In a preferred embodiment, exemplified in FIG. 1, it may be seen that when the control knob (16) is manually rotated, this movement is directly transmitted, by way of the rotating means (14), to the threaded rod (12) forcing said threaded rod or fulcrum rod to work its way through and beyond the drilled and tapped aperture (6) in the bell (2) of the hammer's head (4). It is also important to notice that as this rotation is taking place, the machined section (13) of the threaded rod (12) is gradually exiting or sliding out of the flattened section of the round tubing (14), as it is meant to do so, while the said flattened section still maintains its rotational control over the machined section (13) of the said fulcrum rod (12).

Once said fulcrum rod (12) is exited to the desired extent, said hammer can be used safely and securely to remove nails (7) from a nail bearing surface (8) while at the same time, the disk-like protective pad (11) of elastomeric material affixed to the end of said fulcrum rod (12) prevents the marring of said nail bearing surface.

It is also important to notice that when the user is in the process of removing nails, it may be necessary to re-adjust the fulcrum rod (12) as the nail (7) is gradually pulled out. This can be done by simply turning the control knob (16), thereby adjusting said fulcrum rod (12) with one easy single action. This is in contrast with adjustable fulcrums of the prior art where, to my knowledge, the user would have to disengage the claw from the nail, unlock the fulcrum plunger, manually re-adjust said fulcrum plunger, relock it in its new position, re-engage the nail with the claw, and then resume the work.

Therefore, it will be seen by the user that strategically positioning the control knob (16) at the extremity of the grip end of the handle (5) is not only logical but practical as well. It will also be seen that by virtue of its design, there is no need to lock the fulcrum rod (12) in its extended or retracted position. This will be the case with all the other embodiments herein presented.

OTHER EMBODIMENTS

Although what has been described so far is a prefered embodiment, minor variations may be resorted to without departing from the spirit of the invention. It is this author's intention to demonstrate such variations in a second, third, fourth and fifth embodiment by using FIGS. 2, 3, 4 and 5 respectively.

A second embodiment could be described as follows, using FIG. 2: Where the fulcrum rod (12) of the first embodiment had a machined section (13), the same end of said fulcrum rod (22) could instead be slotted (23) longitudinally so as to accept rotating means consisting of a generally flat, rectangular and thin blade (24) of metal or other suitable material of a width approximating the diameter of the aforementioned fulcrum rod (22) and said blade (24) to be inserted into, and matingly matching in thickness, the said longitudinal slot (23) practiced in the end of the fulcrum rod (22). Again, the length of the slot (23) should accomodate the insertion of a major portion of said blade (24), so that when the need arises to use the present invention, said fulcrum rod (22) can be rotated until it reaches the maximum desired extended position, while at the same time permitting the said blade (24) to slide out of said slot (23) to a distance short of loosing its rotational control over said fulcrum rod (22). As in the first embodiment, the rotating means, namely the said generally rectangular and thin blade (24), made to extrude past the grip end of the hammer's handle (5), is connected (25) to, and terminates with a knob (26), to manually rotate the entire mechanism.

Figures 2, 3, 4, 5:
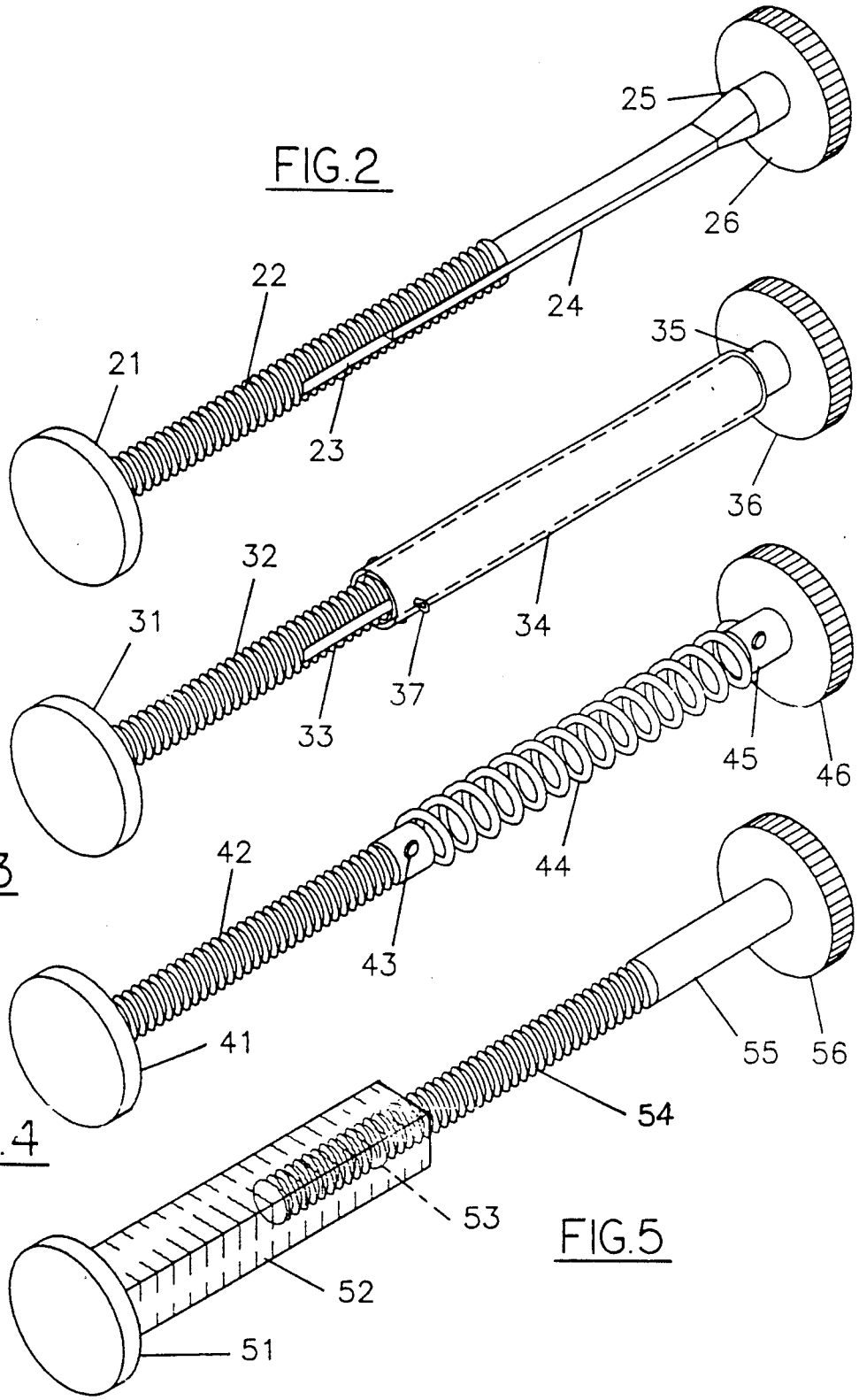
FIGS. 2, 3, 4, and 5 consist of various alternative fulcrum mechanisms, all of them consisting of a threaded rod worming its way through a matching threaded aperture except for FIG. 5, where the fulcrum rod consists of a plunger sliding through an unthreaded aperture in the hammer's head.

In a third embodiment, as shown in FIG. 3, a slotted fulcrum rod (32) could be used in conjunction with a cylindrical rotating means (34) fitted with a transversal pin (37), said pin (37) fulfilling the same purpose as the said blade (24) of the second embodiment. Said pin (37) should be situated at the one end of the said cylindrical rotating means (34) which is slipped over the slotted fulcrum rod (32), said pin (37) being lined up with and inserted into the said slot (33). Needless to say, said rotating means (34) is also connected (35) to, and terminated with an exteriorly affixed control knob (36).

In a fourth embodiment, as shown in FIG. 4, a helical coil (44) or spring, is used as the aforementioned rotating means, by being permanently fastened, by any appropriate means, at one end to the said fulcrum rod (42), and at the other end to the manually operated knob (46), situated at the end of the hammer's handle. Said spring, preferably a tension spring, does not fill the role of pulling in or pushing out the so-called fulcrum rod (42) or plunger as it is known in the prior art, but in this embodiment, the inherent resiliency of the said spring (44) allows it to expand while maintaining its rotating control over the said fulcrum rod (42). In fact, it will be seen that the said spring (44) is elongating at the same rate as the said fulcrum rod (42) is exiting the hammer's head.

As it can readily be seen, the second, third, and fourth embodiments are achieving the same results in much the same way as the first embodiment. Furthermore, it can also be seen by those knowledgeable in the art that the point of maximum stress is in the hammer's head (4) proper, where the fulcrum rod is matingly matching the drilled and tapped aperture (6) practiced therein, thereby making the said hammer's head (4) the perfect and natural medium for the purpose of this invention, since it is already made of steel or other cast metal, thereby eliminating, for this reason, the need for extraneous reinforcing inserts which are common in the prior art.

Derived from this fact is the further advantage that all parts of the fulcrum mechanism per se, except the fulcrum rod itself, can be made of any light material, such as plastic or nylon extrusions.

In a somewhat different fifth embodiment, as seen in FIG. 5, departing from the original concept of a threaded fulcrum rod manually threaded through a tapped aperture (6) in the hammer's head (4), is a fulcrum rod (52), more appropriately called a plunger rod or bar. This said plunger bar (52), as in the other embodiments, is fitted at one end with the customary cushioned tip or pressure pad (51), is preferably of rectangular or square shape in cross section, and is threaded at the other end (53) to matingly match another axially disposed controlling threaded member (54) or screw, connected (55) to and terminating with our now familiar exteriorly affixed manually operated knob (56).

Secondary in importance is whether the plunging fulcrum bar (52) or the controlling threaded member (54) are threaded internally or externally; either one can qualify for the male thread while the other is suitable for the matching female thread. But, the portion of the said fulcrum bar which is extended through and past the hammer's head (4) is smooth (exteriorly unthreaded) so as to match a similarly unthreaded aperture (6) in said head (4). Said aperture (6) has the same preferably rectangular or square cross sectional shape as the said fulcrum bar (52) so as to prevent said bar from being rotated by the said threaded control member (54) or screw as this latter is forcibly rotated by the exposed manually operated knob (56) affixed to its end.

CONSTRUCTION

Concerning the construction aspect of the fulcrum mechanisms, suitable retaining means should be used to prevent the aforementioned rotating means (14, 24, and/or 34) from sliding out of the grip end of the hammer's handle (5). In the case of the now popular hammer covered with a grip sleeve made of elastomeric material, such material may very well be sufficient to retain the so-called rotating means; but those skilled in the art may opt to use cotter pins or other pins, "C" clips, spring clips in combination with retaining washers, or a collar press fitted onto the rotating means in combination with a retaining bushing or ring press fitted inside the handle's end.

To prevent fulcrum rods (12, 22, 32, 42, and 52) from being extruded so far as to escape the controlling hold of the rotating controlling means (14, 24, 34, 44, and 54), a transversal pin or cotter pin, situated in a predetermined location, would effectively stop said rod from entering the said aperture (6) beyond the location fo said pin. For that matter, using a nail punch to smash and otherwise alter any appropriate thread or part of the said fulcrum rods (12, 22, 32, 42 and 52) would be just as adequate and efficient.

If desired, multiple thread can be used, for any of the parts, as this would speed the threading of said parts by increasing the helix angle of their thread. Also the heavy duty ACME type of thread should be considered.

As is seen in many of the prior art teachings, especially where the auxiliary fulcrum mechanism is mostly internal in construction as opposed to being an external attachment, a cavity or recess can be practiced in the hammer's bell (2) to accomodate, partly or wholly, the cushioned pressure pad (11, 21, 31, 41, 51) affixed to the extremity of the said fulcrum mechanism. On the other hand, the suggested pressure pad of the present invention is so thin in construction as to not be an obstruction to the user while using the hammer for its primary purpose. However, another way to remediate to this minor problem is to redesign the hammer's anvil (1) and relocate said anvil on the same plane as and flush with the outer surface of the said pressure pad. This would in fact permit the user to nail very close to a surface perpendicular to the nailing surface (8).

CONCLUSION AND SCOPE OF INVENTION

It is believed that from the foregoing description, the operation of the hammer fulcrum embodying the invention will be apparent to those skilled in the art, as it will be clear that all the objects recited above are amptly achieved by the same invention. Further description would appear unnecessary. It is understood that changes may be made in the minor details of construction, arrangement and combination of parst without departing from the spirit of the invention or the scope of the appended claims. It is also understood that although all five embodiments may find their natural application in the now commonly used hammer fabricated with a hollow pipe for a handle, it is by no means restricted to such construction. The common all wood or all fiberglass handle can very well be hollowed out and otherwise altered to suit the purpose of this invention.

I claim:

1. A hammer comprising a handle and a head, said handle having a bore, said head including an anvil, a bell and claw, said bell having an aperture in line with said bore, an adjustable fulcrum mechanism disposed axially within said bore and aperture comprising an extendable fulcrum rod threadedly engaging said aperture, rotatable controlling means coupled to said fulcrum rod and having terminally affixed thereto an exteriorly exposed control knob at the end of said handle opposite said head, and wherein the said rotatable controlling means comprises a cylindrical member flattened at one end to matingly engage a portion of said fulcrum rod, said portion being machined flat on at least two sides.

2. A hammer comprising an elongated handle, a bore extending lengthwise within said handle, a head at one end of said handle, said head including an anvil, a bell and a claw, an aperture in said bell opening into said bore in general alignment therewith, an elongated, axially movable fulcrum rod extending lengthwise within said bore and aperture, and mechanism for axially moving said fulcrum rod between an operative position projecting beyond said aperture to serve as a fulcrum and a retracted position, said mechanism comprising a rotatable adjustment knob on the end of said handle opposite said head in a position for convenient operation by the user of said hammer, an elongated member within said bore non-rotatably connected to said adjustment knob, and means responsive to rotation of said elongated member by said adjustment knob for longitudinally moving said fulcrum rod between said operative and retracted positions.

3. A hammer as defined in claim 2, wherein said means includes a threaded connection between said fulcrum rod and said aperture and a longitudinally slidable, non-rotatable connection between said fulcrum rod and said elongated member.

4. A hammer as defined in claim 3, wherein said fulcrum rod and elongated member have mutually telescoping portions of non-circular cross-section providing said longitudinally slidable non-rotatable connection.

5. A hammer as defined in claim 3, wherein said fulcrum rod and elongated member have interengaging portions, one said portion having a longitudinal slot, the other said portion comprising an elongated relatively thin, flat bar longitudinally, slidably engaged in said slot to provide said longitudinally slidable, non-rotatable connection.

6. A hammer as defined in claim 3, wherein said fulcrum rod and elongated member have interengaging portions, one said portion having an elongated slot, the other said portion comprising a transverse pin extending across said elongated member and longitudinally slidably engaged in said slot to provide said longitudinally slidable, non-rotatable connection.

7. A hammer as defined in claim 2, wherein said means includes a threaded connection between said fulcrum rod and said aperture, and said elongated member comprises a coil spring capable of longitudinal extension and contraction.

8. A hammer as defined in claim 2, wherein said means includes a threaded connection between said fulcrum rod and said elongated member, and a longitudinally slidable, non-rotatable connection between said fulcrum rod and said aperture.

* * * * *